US005456361A

United States Patent [19]

Walsh et al.

[11] Patent Number: 5,456,361

[45] Date of Patent: Oct. 10, 1995

[54] ORAL AND OPTHO CARE TRAY

[76] Inventors: Robert P. Walsh; Susan A. Walsh, both of 625 Willow Ave., Hoboken, N.J. 07030

[21] Appl. No.: 187,334

[22] Filed: Mar. 3, 1994

[51] Int. Cl.[6] ..... A45D 44/00

[52] U.S. Cl. ..... 206/570; 206/5.1; 206/63.5; 206/581; 132/315

[58] Field of Search ..... 206/5, 5.1, 6, 63.5, 206/83, 370, 570, 823, 581; 132/315; 220/339

[56] References Cited

U.S. PATENT DOCUMENTS

| | | | |
|---|---|---|---|
| 1,512,981 | 10/1924 | Gordon | 132/315 |
| 1,623,877 | 4/1927 | Kjetsaa | 132/315 |
| 1,707,021 | 3/1929 | Lea et al. | 132/315 |
| 2,375,645 | 5/1945 | Gordon | 206/83 |
| 2,499,332 | 2/1950 | Schiff | 206/5 R |
| 3,337,047 | 8/1967 | Otis | 206/5.1 |
| 4,763,791 | 8/1988 | Halverson et al. | 206/570 |
| 4,909,382 | 3/1990 | Cuppari | 206/581 |
| 4,925,033 | 5/1990 | Stoner | 206/581 |
| 4,936,463 | 6/1990 | Tiramani | 132/315 |
| 5,095,924 | 3/1992 | Stanfield | 132/315 |

FOREIGN PATENT DOCUMENTS

| | | | |
|---|---|---|---|
| 2371901 | 6/1978 | France | 132/315 |
| 3435023 | 4/1986 | Germany | 206/581 |

*Primary Examiner*—Jimmy G. Foster

*Attorney, Agent, or Firm*—Sughrue, Mion, Zinn, Macpeak & Seas

[57] ABSTRACT

A tray is provided with receptacles for storing hygienic care items in an organized manner to facilitate their use, and also includes receptacles for use when administering to personal hygiene, e.g., receptacles for rinsing contact lenses, for receiving used mouthwash, etc. The tray is provided with a hinged lid and is integrally molded.

5 Claims, 2 Drawing Sheets

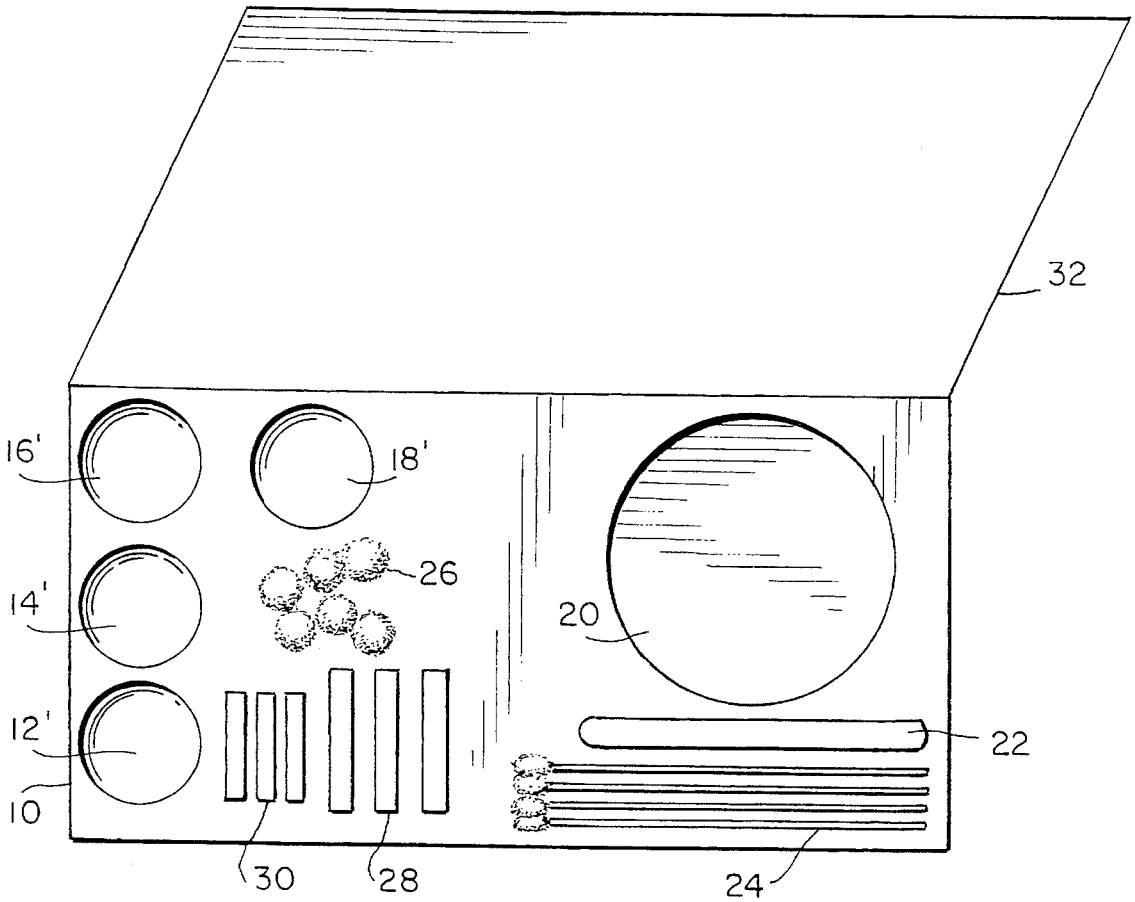
FIG. 2
FIG. 3
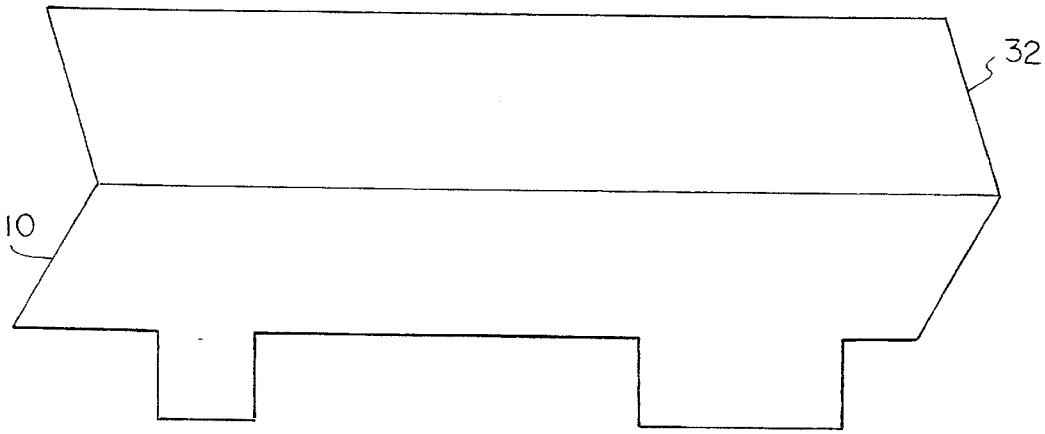

ORAL AND OPTHO CARE TRAY

BACKGROUND OF THE INVENTION

The present invention relates to personal hygiene storage apparatus, and more particularly to an apparatus for efficiently and conveniently storing items useful for hygienic care, e.g., of the mouth and eye areas.

From time to time, many persons have a need to avail themselves of the services in a health-care facility. Among the items needed in these facilities is a personal supply of products necessary to perform sound daily oral hygiene practices. Space is limited in health-care facilities, so one cannot store a large variety and number of supplies to carry out the tasks. However, the caregivers in these facilities must have easy access to the supplies necessary for administering to an individual's needs. Having all of the necessary supplies readily at hand ensures that care can be given in a more timely fashion.

In addition, persons travelling will often have a need for supplies for administering to personal hygienic needs, and existing kits for this purpose do not store the number and variety of supplies needed, and while they may provide many of the supplies needed, they do not provide the facilities needed to use those supplies.

There is a need, then, for an apparatus for storing and efficiently organizing oral and optho hygienic materials, which also facilitates the use of those materials.

SUMMARY OF THE INVENTION

The above and other objects of the invention are achieved by a tray provided with receptacles for storing hygienic care items in an organized manner to facilitate their use, the tray also including receptacles for use when using the stored articles or otherwise administering to personal hygiene, e.g., receptacles for rinsing contact lenses, etc. The tray is provided with a hinged lid and is integrally molded.

BRIEF DESCRIPTION OF THE DRAWINGS

The invention will be more clearly understood from the following description in conjunction with the accompanying drawings wherein:

FIG. 2 is a view similar to FIG. 1 but illustrating a hinged lid for the tray; and FIG. 3 is a side view illustrating the operation of the hinged lid.

DETAILED DESCRIPTION OF THE INVENTION

Figure 1:
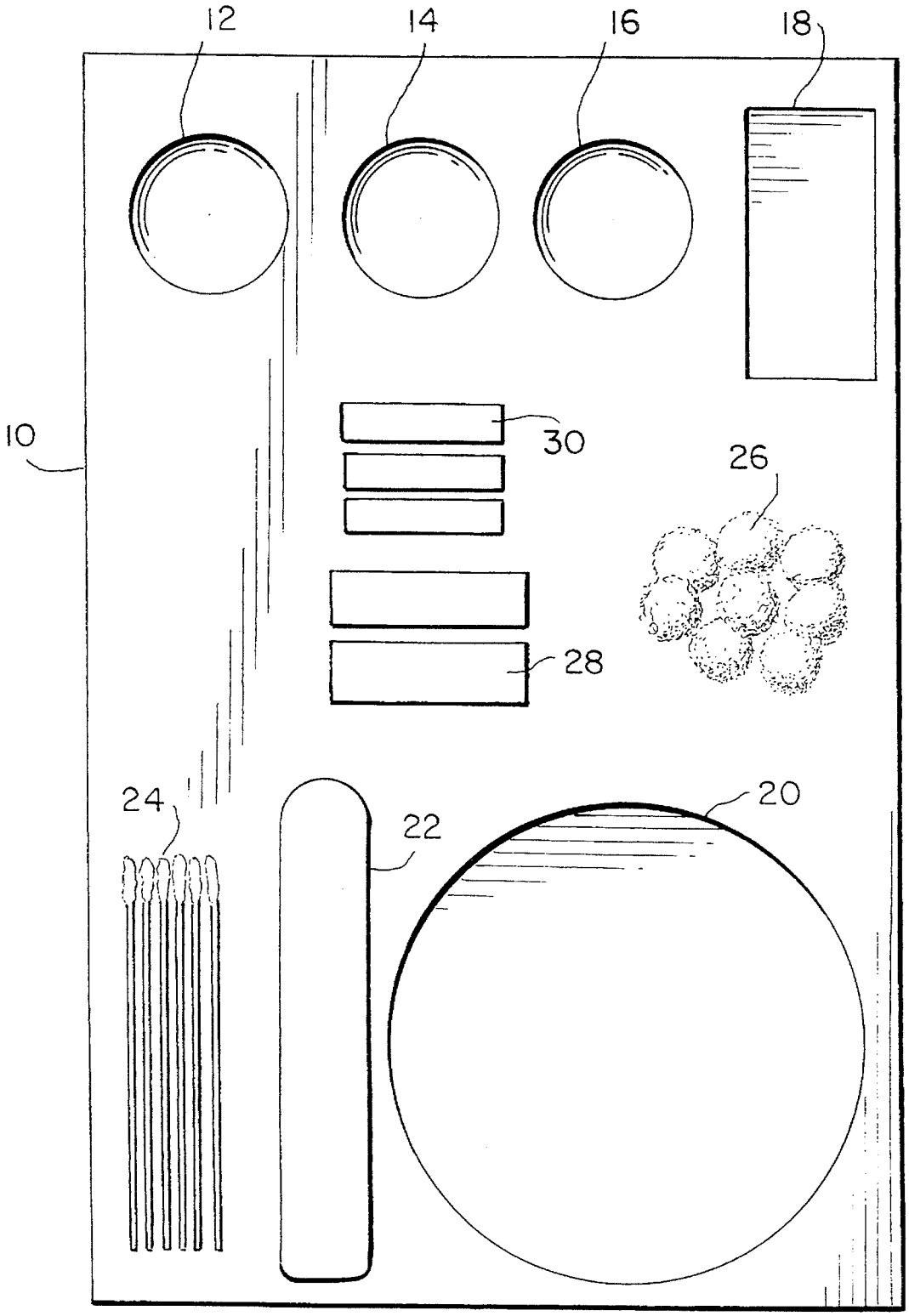
FIG. 1 is a plane view of the apparatus according to the present invention, illustrating the size and location of various receptacles for storage of hygienic materials.

As can be seen from the above description, the present invention provides an apparatus for storing and organizing personal hygienic supplies in a compact but functional manner, and would be highly useful not only to health care workers but also to individuals administering to themselves.

FIG. 1 is a plan view of the storage tray according to the present invention, showing the size and location of various receptacles. The tray 10 is generally rectangular in shape, e.g., 9" long by 6" wide by 1½" deep. It is constructed of thermo-forming or injection molded plastic, such as polystyrene or polypropylene. The inside of the tray has indentations 12 and 14 for use while administering to the right eye and left eye, respectively, and a receptacle 16 which is available when using mouthwash. A receptacle 18 holds lip balm.

A large diameter, e.g., 2½" in diameter, receptacle 20 may be used for holding dentures. Also included are storage areas for a tongue blade 22, glycerine and lemon mouth swabs 24, cotton balls 26, as well as packets of mouthwash and saline solution 30. The saline packets and cotton balls can be used when providing eye care, with the receptacles 12 and 14 used to hold the saline solution when rinsing contacts, or to hold waste materials, e.g., used cotton balls, after completion. The remainder of the items are usable when providing mouth care.

In FIGS. 2 and 3, the hinged lid 32 is shown and this can be used to protect the items when the kit is not in use.

It should be noted that the exact size and location of the various receptacles may change, e.g., the lip balm receptacle 18 may be round rather than rectangular, as shown at 18' in FIG. 2, and the contents of the receptacles can be arranged differently, as shown by comparing the contents of the receptacles 12', 14' and 16' in FIG. 2 with the corresponding receptacles 12–16 in FIG. 1.

The hygienic care tray according to the present invention can be used not only by health care workers but also for travelers in airports, hotels, etc. An embodiment designed to address the needs of the traveler can be equipped with deodorant, shampoo, toothpaste, toothbrush, hair comb and brush, etc., needed for basic daily hygiene needs. The tray could be available in different sizes, and is not limited to hygiene materials directed to oral and optho care, but could be directed to any one or more areas of personal hygiene, e.g., eyes, mouth, hair.

It will be appreciated that various changes and modifications can be made to the embodiment described above without departing from the spirit and scope of the invention as defined in the appended claims.

What is claimed:

1. A hygiene kit for use in administering to the personal hygiene of an individual, said kit comprising:

a container base of a single integral piece having a plurality of first receptacles therein for holding personal hygiene materials including at least a first receptacle storing mouthwash and at least a second receptacle storing saline solution for use in rinsing contact lenses;

at least one third receptacle in said container base capable of holding fluids and for use in rinsing contact lenses with said saline solution; and at least one fourth receptacle in said container base capable of holding fluids and for use during use of said mouthwash.

2. A kit according to claim 1, further including a receptacle storing cotton swabs.

3. A kit according to claim 1, further including a receptacle storing cotton balls.

4. A kit according to claim 1, further including a receptacle holding dentures.

5. A kit according to claim 1, further including a receptacle holding lip balm.

* * * * *